US006035488A

United States Patent [19]

Kawakatsu

[11] Patent Number: 6,035,488

[45] Date of Patent: Mar. 14, 2000

[54] VEHICLE SLIDING DOOR STOPPER HAVING CONCAVITIES FORMED THEREIN

[75] Inventor: Fukuyoshi Kawakatsu, Komaki, Japan

[73] Assignee: Tokai Rubber Industries, Ltd., Japan

[21] Appl. No.: 09/181,324

[22] Filed: Oct. 28, 1998

[30] Foreign Application Priority Data

Nov. 11, 1997 [JP] Japan ..... 9-308960

[51] Int. Cl.[7] ..... E05F 5/06

[52] U.S. Cl. ..... 16/86 R; 16/85

[58] Field of Search ..... 16/86 R, 86 A, 16/85, DIG. 17; 292/DIG. 15, 341.12; 49/460; 296/155

[56] References Cited

U.S. PATENT DOCUMENTS

| | | | |
|---|---|---|---|
| 1,978,249 | 10/1934 | Decarie | 16/86 R |
| 3,472,546 | 10/1969 | Samuels | 16/86 R |
| 5,233,724 | 8/1993 | Lei Tert et al. | 16/86 A |
| 5,517,721 | 5/1996 | Roth et al. | 16/86 R |
| 5,802,671 | 9/1998 | Ikuma | 16/85 |

FOREIGN PATENT DOCUMENTS

| | | | |
|---|---|---|---|
| 769344 | 10/1967 | Canada | 16/86 R |
| 604215A1 | 6/1994 | European Pat. Off. | 16/86 R |
| 4-29571 | 5/1992 | Japan . | |
| 4-130512 | 11/1992 | Japan . | |
| 5-18466 | 5/1993 | Japan . | |

*Primary Examiner*—Chuck Y. Mah
*Attorney, Agent, or Firm*—Wall Marjama Bilinski & Burr

[57] ABSTRACT

A sliding door stopper for limiting a sliding movement of a vehicle sliding door in a direction of opening of the sliding door, by abutting contact of the sliding door with the sliding door stopper in a cushioning manner, wherein the sliding door stopper is attached to a guide rail which is mounted on a vehicle body, and the sliding door is suspended from and guided by the guide rail so as to be slidable along the guide rail, the sliding door stopper comprising: an elastic body extending in a longitudinal direction of the guide rail away from the longitudinal end of the guide rail and having opposite longitudinal end faces one of which is adapted for abutting contact with the sliding door, the elastic body having a plurality of concavities each of which is formed in an outer surface of the elastic body so as to extend in a direction intersecting a longitudinal direction of the elastic body which is parallel to the longitudinal direction of the guide rail.

12 Claims, 8 Drawing Sheets

VEHICLE SLIDING DOOR STOPPER HAVING CONCAVITIES FORMED THEREIN

The present application is based on Japanese Patent plication No. 9-308960 filed Nov. 11, 1997, the content which is incorporated hereinto by reference.

BACKGROUND OF THE INVENTION

1. Field of the Invention

The present invention relates in general to a sliding door stopper for limiting a sliding movement of a sliding door in its direction of opening in a damping or cushioning manner. Such a sliding door is employed for a cab-over type one box recreational or commercial vehicle, or other types of vehicle having a door opening in a side panel thereof, wherein the sliding door is adapted to be movable generally in parallel to the running direction along the vehicle side panel between its fully open and closed positions. More particularly, the present invention is concerned with such a sliding door stopper including a rubber block attached to a longitudinal end of a guide rail from which the sliding door is suspended.

2. Discussion of the Related Art

As one type of the sliding door employed for the recreational vehicle or commercial vehicle, there is known a sliding door having a construction in which rollers are attached to an upper portion of the sliding door, so that the rollers are supported and guided by a guide rail which is mounted on the vehicle body above the door opening, whereby the sliding door is suspended from the guide rail. In such a construction, a rubber buffer is generally attached to a longitudinal end of the guide rail, so that the roller or other part of the sliding door is brought into abutting contact with the rubber buffer when the sliding door has been moved to its fully open positioned. Thus, the sliding movement of the sliding door is limited, and its fully open position can be established in a cushioning or damping manner.

However, the above-described prior art arrangement in which the rubber buffer takes the form of an elastic body constituted simply by a solid rubber block, suffers from a drawback that the sliding door is likely to rebound or return from its fully open position towards its fully closed position due to a large restoring force generated by an elasticity of the elastic body, where the sliding door has been quickly moved to the fully open position, namely, where the sliding door is strongly brought into abutting contact with the rubber buffer. The guide rail has, in general, a protrusion in the form of a plate spring which is formed in the vicinity of its door opening end, so as to serve as a holding mechanism for holding the opened sliding door in the fully open position. That is, when the sliding door is moved towards the fully open position, the roller attached to the sliding door rolls over this protrusion just before the sliding door reaches the fully open position, so that the sliding door is held in the fully open position after the roller has passed the protrusion. However, the protrusion constituted by the plate spring has a difficulty in sufficiently preventing the sliding door from rebounding from the fully open position, particularly, where the sliding door is quickly opened.

Recently, there has been proposed an arrangement in which a locking mechanism is provided between the lower portion of the sliding door and the vehicle body, in an attempt to assuredly prevent the sliding door from being rebounding from the fully open position. According to the proposed arrangement, the sliding door is automatically locked in the fully open position, upon arrival of the sliding door at the fully open position. However, this arrangement also suffers from a drawback where the sliding door is quickly moved to be opened. That is, when the sliding door is strongly brought into abutting contact with the rubber buffer, the upper portion of the sliding door is forced back towards the fully closed position due to the elastic restoring force generated by the rubber buffer, whereby the entirety of the sliding door is shaked or rattled, accordingly making the vehicle operator or driver feel uneasy or even uncomfortable with the door opening operation. In the worst case, the sliding door is likely to interfere with the vehicle body due to a heavy shake of the sliding door, possibly resulting in some scratches or other damages on the vehicle body.

SUMMARY OF THE INVENTION

It is therefore an object of the present invention to provide a simply constructed stopper attached to a longitudinal end of a guide rail which holds a vehicle sliding door suspended thereby, so as to limit sliding movement of the sliding door at its fully open position in a cushioning manner, for thereby advantageously minimizing or preventing a rebounding motion of the sliding door when the sliding door has been moved to its fully open position.

The above object may be achieved according to the principle of the present invention, which provides a sliding door stopper for limiting a sliding movement of a vehicle sliding door relative to a vehicle body in a direction of opening of the sliding door to a fully open position thereof, by abutting contact of the sliding door with the sliding door stopper in a cushioning manner, wherein the sliding door stopper is attached to a longitudinal end of a guide rail which is mounted on the vehicle body, and the sliding door is suspended from and guided by the guide rail so as to be slidable along the guide rail, the sliding door stopper comprising:

an elastic body extending in a longitudinal direction of the guide rail away from the longitudinal end of the guide rail and having opposite longitudinal end faces one of which is adapted for abutting contact with the sliding door, the elastic body having a plurality of concavities each of which is formed in an outer surface of the elastic body so as to extend in a direction intersecting a longitudinal direction of the elastic body which is parallel to the longitudinal direction of the guide rail.

In the present sliding door stopper of the present invention constructed as described above, the elastic body is elastically deformed upon abutting contact with the sliding door, thereby damping an abutting impact acting on the sliding door. This elastic body is formed to have an elongate shape extending parallel to a direction in which the impact load is applied to the elastic body (a direction in which the sliding door is moved), thereby permitting the elastic body to be elastically deformed over a distance large enough to effectively alleviate the abutting impact. Further, the presence of the concavities each formed in the outer surface of the elastic body and extending perpendicularly or obliquely to the longitudinal direction is effective to further reduce the spring constant of the elastic body, thereby improving the cushioning or damping effect provided by the elastic body. More specifically, the elastic body exhibits the sufficiently reduced spring constant, particularly, in an initial period of the elastic deformation in which each concavity is deformed until longitudinally opposite side faces of the concavity are brought into contact with each other. After the initial period, the spring constant of the elastic body is non-linearly increased as the elastic deformation further progresses. The thus varying spring constant permits the elastic body to satisfactorily damp the impact load while assuredly limiting the sliding movement of the sliding door.

In the prior art, the sliding door stopper which is attached to the longitudinal end of the guide rail and accommodated within a considerably small space such as a space within the guide rail, takes the form of a rubber buffer constituted simply by a solid rubber block, as described above. However, a study developed by the present inventor revealed that the provision of the concavities in the rubber block having a specific shape permits the sliding door stopper to have a sufficiently high degree of durability and an outstandingly improved cushioning or damping effect, without complicating the construction or increasing the size of the sliding door stopper. Consequently, the sliding door is advantageously prevented from being rebounded or shaking during the opening operation of the sliding door.

It is to be understood that each concavity may take the form of a groove having a width substantially constant as viewed in the direction perpendicular to the longitudinal direction, or a pocket having a length comparatively small along the periphery of the elastic body as viewed in transverse cross section, or may take any other shape. The elastic body may have a circular shape, a rectangular shape or other polygonal shape in its transverse cross section. For assuring the high durability of the elastic body, the cross sectional shape is preferably substantially constant as viewed in the longitudinal direction, or alternatively the cross sectional area may be progressively decreased in a direction towards the end face with which the sliding door is brought into contact. Where the elastic body is accommodated in the guide rail, it is preferable that the cross section of the elastic body be configured or dimensioned such that the outer dimensions of the elastic body are only slightly smaller than the inner dimensions of the guide rail, so that the elastic body is easily fitted in the guide rail, for thereby obtaining a sufficiently large volume of the elastic body while facilitating the attachment of the elastic body into the guide rail. It is noted that the elastic body does not necessarily have to be accommodated in the guide rail so as to be attached to the guide rail, but the arrangement or construction for the attachment of the elastic body to the guide rail may be determined as needed depending upon the shape of the guide rail or other factor. It is also noted that the construction of the guide rail on which the sliding door stopper of the present invention is installed is not particularly limited. The present sliding door stopper may be installed on, for example, a guide rail which is mounted on the side panel of the vehicle body and which has a channel or gutter which is open upward. In this case, the channel-shaped guide rail accommodates and guides rollers which are fixed to an upper portion of the sliding door through a suitable arm or bracket.

According to a first preferred form of the present invention, each of the concavities has a predetermined depth which is smaller than a distance from the outer surface to a central axis of the elastic body which is parallel to the longitudinal direction thereof.

In this first preferred form of the invention, each cavity has the predetermined depth which is smaller than the distance from the outer surface of the elastic body to the central axis of the elastic body, whereby local stress concentration in the elastic body is advantageously minimized or prevented, and an accordingly high degree of durability of the elastic body is obtained.

According to one advantageous arrangement of the first preferred form, the concavities are spaced apart from each other as viewed in the longitudinal direction of the elastic body. In this arrangement of the first preferred form, the concavities may be formed, for example, in opposite surfaces of the rectangular elastic body which are laterally opposed to each other with respect to the central axis, such that the concavity or concavities formed in one of the opposite surfaces and the concavity or concavities formed in the other of the opposite surfaces are alternately located as viewed in the longitudinal direction, for thereby further minimizing local stress concentration while assuring a further reduced spring constant with a smaller impact resilience.

According to another advantageous arrangement of the first preferred form of the invention, the concavities extend from the outer surface in respective directions at least two of which are different from each other.

In this advantageous arrangement of the first preferred form of the invention, the concavities are formed, for example, to be substantially equi-anglarly spaced apart from each other as viewed in the circumferential direction of the elastic body, or alternatively, may be formed such that at least two of the concavities are located in respective phase angles different from each other as viewed in the circumferential direction, so as to further reduce the local stress concentration while further reducing the spring constant with a smaller impact resilience. In the latter case, it is preferable that the concavities located in the same phase angle be not adjacent to each other but be spaced apart from each other as viewed in the longitudinal direction.

According to a second preferred form of the invention, a laterally outer side portion of the elastic body has a smaller volume than a laterally inner side portion of the elastic body, the laterally outer side portion being located on one of laterally opposite sides of a central axis of the elastic body which is remote from an interior of the vehicle body, the laterally inner side portion being located on the other of the laterally opposite sides of the central axis of the elastic body, the central axis being parallel to the longitudinal direction of the elastic body.

In the second preferred form in which the volume of the laterally outer side portion of the elastic body is smaller than that of the laterally inner side portion of the elastic body, the elastic body is contracted or deformed in the longitudinal direction upon abutting contact with the sliding door such that the abutting end portion of the elastic body is displaced towards the exterior of the vehicle body, so that the opened sliding door is held displaced towards the exterior of the vehicle body. Consequently, the sliding door is prevented from being displaced towards the interior of the vehicle body and accordingly prevented from undesirably interfering with the side panel or other part of vehicle body, thereby advantageously preventing scratches or other damages on the vehicle body.

According to an advantageous arrangement of second preferred form of the invention, the elastic body has a cutout which is formed in the laterally outer side portion of the elastic body and which extends in the longitudinal direction of the elastic body. In this arrangement, the cutout may be formed in the laterally outer side portion, for example, so as to extend throughout the entire length of the elastic body, so that the volume of the laterally outer side portion is efficiently made smaller than that of the laterally inner side portion.

According to a third preferred form of the present invention, each of the concavities has a predetermined depth such that a laterally outer side portion of the elastic body has a smaller spring constant with respect to a load applied thereto in the longitudinal direction, than a laterally inner side portion of the elastic body, the laterally outer side portion being located in one of laterally opposite sides of a central axis of the elastic body which is remote from an interior of the vehicle body, the laterally inner side portion being located on the other of the laterally opposite sides of the central axis of the elastic body, the central axis being parallel to the longitudinal direction of the elastic body.

In this third preferred form, the spring constant of the laterally outer side portion of the elastic body is advantageously made smaller than that of the laterally inner side portion of the elastic body, by forming the concavity or concavities in each of the laterally outer and inner side portions of the elastic body such that each concavity formed in the laterally outer side portion has a depth larger than that of each concavity formed in the laterally inner side portion, for example.

Where the spring constant in the laterally outer side portion of the elastic body is adapted to be smaller than that in the laterally inner side portion of the elastic body, the elastic body is contracted or deformed upon abutting contact with the sliding door such that the abutting end portion of the elastic body is displaced towards the exterior of the vehicle body, so that the opened sliding door is held displaced towards the exterior of the vehicle body. Consequently, the sliding door is prevented from being displaced towards the interior of the vehicle body and accordingly prevented from undesirably interfering with the side panel or other part of vehicle body, thereby advantageously preventing scratches or other damages on the vehicle body.

According to a fourth preferred form of the invention, the above-described one of opposite longitudinal end faces of the elastic body is inclined with respect to a direction perpendicular to the longitudinal direction of the elastic body, such that a length of the elastic body increases as viewed in a direction away from a laterally outer side portion of the elastic body toward a laterally inner side portion of the elastic body, the laterally outer side portion being located on one of laterally opposite sides of a central axis of the elastic body which is remote from an interior of the vehicle body, the laterally inner side portion being located on the other of the laterally opposite sides of the central axis of the elastic body, the central axis being parallel to the longitudinal direction of the elastic body.

In this fourth preferred form in which the longitudinal end face of the elastic body is inclined as described above, the sliding door is guided by the inclined end face of the elastic body towards the exterior of the vehicle and is displaced towards the exterior of the vehicle, upon abutting contact with the inclined end face of the elastic body. Consequently, the sliding door is prevented from being displaced towards the interior of the vehicle body and accordingly prevented from undesirably interfering with the side panel or other part of vehicle body, thereby advantageously preventing scratches or other damages on the vehicle body, as in the above-described third preferred form.

According to a fifth preferred form of the present invention, the sliding door stopper further comprises an attaching member which is made of a synthetic resin, the attaching member being fixed to the other of the opposite longitudinal end faces of the elastic body, the sliding door stopper being fixedly attached through the attaching member to the longitudinal end of the guide rail.

The sliding door stopper according to the fifth preferred form of the present invention is fixedly attached to the guide rail, at its proximal end (remote from the other or distal end with which the sliding door is brought into contact). The fifth preferred form of the present invention provides an inexpensive and lightweight sliding door stopper which is easily attached to the guide rail with a sufficiently large strength. The synthetic resin is employed as the material of the attaching member, whereby the attaching member is easily formed to have a complicated shape which permits the sliding door stopper to be firmly and stably fixed to the guide rail. However, it is noted that the constriction for the attachment of the sliding door stopper to the guide rail may be determined as needed. The elastic body may be bonded at its proximal end directly to the guide rail in a vulcanization process, without simultaneous formation of the attaching member with the elastic body.

According to a first advantageous arrangement of the fifth preferred form, the attaching member has a reinforcing plate which is embedded in a portion of the attaching member, the portion of the attaching member constituting an engaging portion which engages the longitudinal end of the guide rail.

The reinforcing plate, which may be made of a metallic material, for example, can be embedded in a portion of the attaching member made of the synthetic resin, so that the above-indicated portion of the attaching member accommodating therein the reinforcing member constitutes the engaging portion. The provision of the reinforcing plate in the attaching member increases the strength or rigidity of the attaching member, particularly, in its portion for the connection of the attaching member with guide rail, whereby the attaching member is further firmly and stably fixed to the guide rail. Further, the presence of the reinforcing member in the engaging portion permits the engaging portion to have an elastic or resilient restoring force (spring force), whereby the attaching member can be more stably attached to the guide rail.

According to a second advantageous arrangement of the fifth preferred form, the attaching member includes a pair of lateral engaging portions and an end engaging portion which are formed integrally with the attaching member, the lateral engaging portions projecting from respective laterally opposite surfaces of the attaching member, the end engaging portion projecting from one of opposite end faces of the attaching member which is remote from the elastic body.

In this second advantageous arrangement of the fifth preferred form, the pair of lateral engaging portions and the end engaging portion are brought into engagement with the respective three portions of the guide rail, i.e., the end wall and the laterally opposite walls of the guide rail, so that the attaching member is stably and firmly fixed to the guide rail. This feature of the second advantageous arrangement may be combined with that of the above-described first advantageous arrangement, wherein the reinforcing plate is embedded in one or two of the three engaging portions, for example, so that the one or two engaging portion or portions is/are reinforced. The reinforcing plate is embedded preferably at least in the end engaging portion which tends to be subjected to a larger load than the other engaging portions, thereby efficiently reinforcing the attaching member without enlarging the attaching member. It is noted that the specific arrangement or construction for the attachment of the synthetic-resin made attaching member to the guide rail is not limited to a specific one but may be determined as needed depending upon the shape of the guide rail.

BRIEF DESCRIPTION OF THE DRAWINGS

The above and optional objects, features, advantages and technical and industrial significance of the present invention will be better understood by reading the following detailed description of a presently preferred embodiment of the invention, when considered in connection with the accompanying drawings, in which.

DETAILED DESCRIPTION OF THE PREFERRED EMBODIMENT

Figure 8:
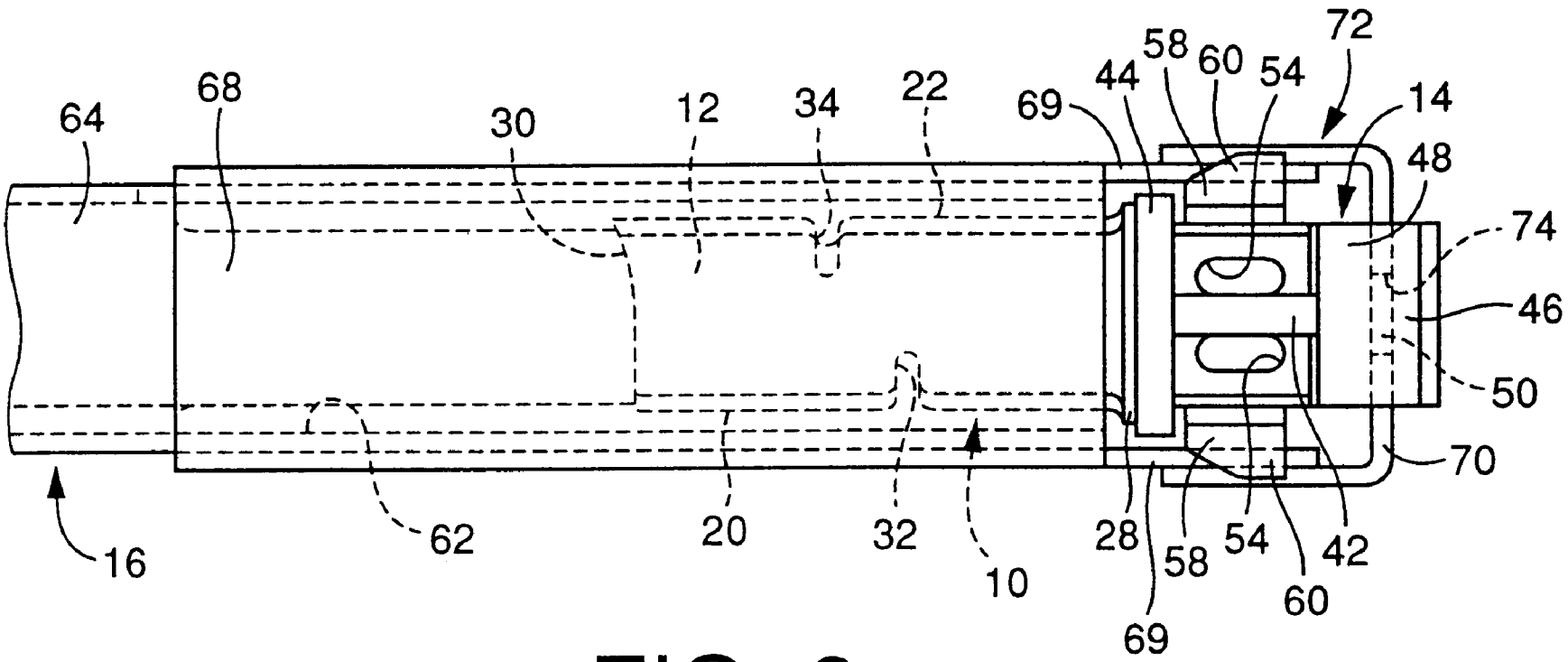
FIG. 8 is a plan view of the stopper of FIG. 1 as attached to a guide rail for the sliding door.
Figure 9:
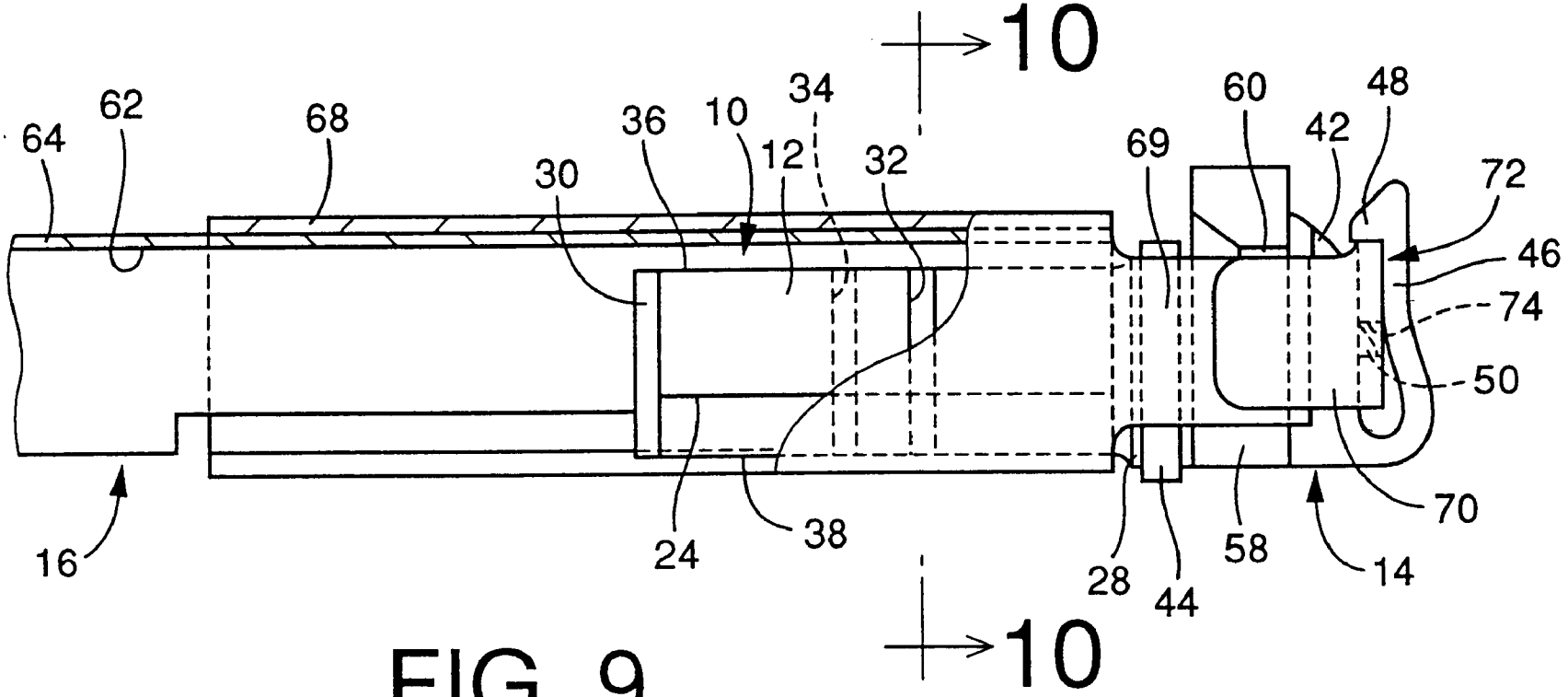
FIG. 9 is a front elevational view partly in cross section, showing the stopper and the guide rail of FIG. 8.

Referring to FIGS. 1–10, there is shown a sliding door stopper 10 for limiting sliding movement of a sliding door of a motor vehicle at its fully open position, which stopper 10 is constructed according to one embodiment of this invention. This sliding door stopper 10 shown in the front elevational and top plan view of FIGS. 1 and 2, includes a rubber block 12 which is an elastic rubber body formed of a rubber material, and an attaching member 14 made of a synthetic resin and bonded to the rubber block 12, as shown in FIGS. 1–7. The sliding door is supported by and suspended from a guide rail 16 shown in FIGS. 8–10, which is mounted on a side panel of a body of the vehicle, so that the sliding door is slidably moved along the guide rail 16. The attaching member 14 fixedly engages a longitudinal end of the guide rail 16, so that the sliding door stopper 10 is attached to the guide rail 16 with the rubber block 12 being accommodated in the guide rail 16, as shown in FIGS. 8 and 9.

Figure 1:
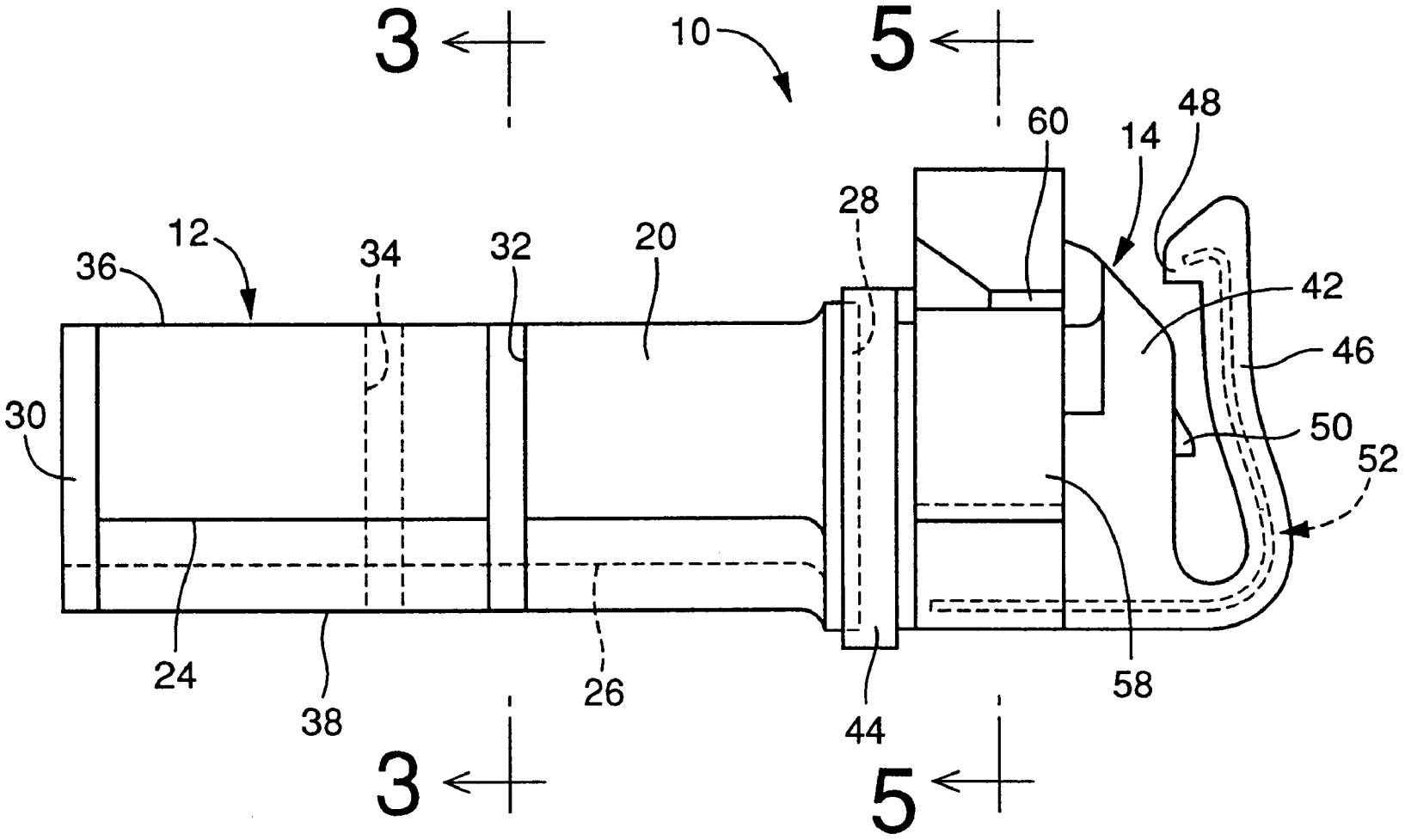
FIG. 1 is a front elevational view of a stopper for a vehicle sliding door, which is constructed according to one embodiment of the present invention.
Figure 3:
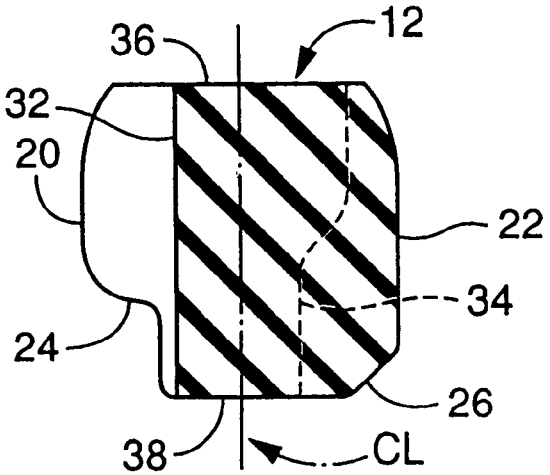
FIG. 3 is a cross sectional view taken along line 3—3 of FIG. 1.

Described more specifically, the rubber block 12 is an elongate block having a substantially rectangular transverse cross sectional shape which is almost constant throughout its entire length or as viewed in the longitudinal direction. The rubber block 12 has a left side surface 20 (which is located on the left side in FIG. 3 that is a cross sectional view taken along line 3—3 of FIG. 1) and a right side surface 22, which are both curved so as to come progressively closer to each other as the two opposite surfaces 20, 22 extend in the upward direction, as best seen in FIG. 3. The left side surface 20 has at its lower end portion a cutout portion 24 having a substantially rectangular cross sectional shape, as shown in FIGS. 1 and 3. Namely, the lower end portion of the left side surface 20 is removed down to a predetermined depth over the entire length of the rubber block 12, so that the cutout portion 24 is formed to extend over the entire length, as shown in FIG. 1. The right side surface 22 has at its lower end portion a chamfered portion 26 which is also formed to extend throughout the entire length of the rubber block 12. These cutout and chamfered portions 24, 26 prevent the rubber block 12 from interfering with the vehicle body, the guide rail 16 or other elements. In FIG. 1, the upper margin of the chamfering portion 26 is indicated by a broken line.

Figure 2:
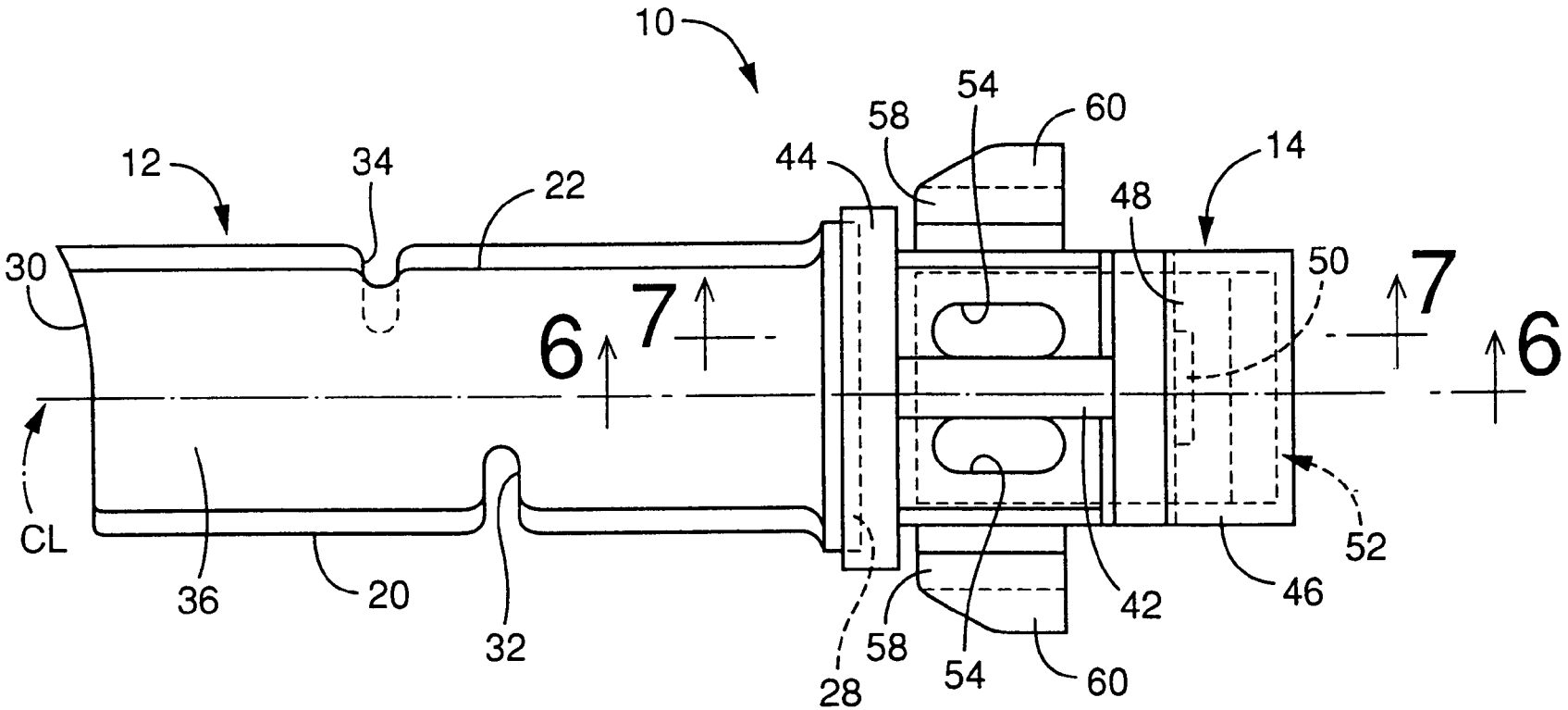
FIG. 2 is a plan view of the stopper of FIG. 1.

The rubber block 12 further has a fixing portion 28 at its proximal or fixed end (which is the right one of its longitudinally opposite ends as viewed in FIG. 1 or 2), and a curved end face 30 at its distal or free end (which is the left one of its longitudinally opposite ends as viewed in FIG. 1 or 2). The fixing portion 28, to which the attaching member 14 is fixed, is a rectangular plate-like portion formed integrally with the main body of the rubber block 12, and protrudes from the outer surface of the main body outwardly in a lateral direction perpendicular to the longitudinal direction of the rubber block 12. The curved end face 30 as a whole is not perpendicular to the longitudinal direction of the rubber block 12, but is generally curved such that the right side portion of the curved surface 30 nearer to the above-described right side surface 22 projects a larger distance in the longitudinal direction, than the left side portion of the curved surface 30 nearer to the above-described left side surface 20. Described more specifically, the right side portion on one of the opposite sides of the lateral center line is curved such that the length of the rubber block 12 continuously increases in the direction away from the lateral center line towards the right side surface 22, while the left side portion on the other side of the lateral center line is substantially flat or straight, as shown in FIG. 2.

The rubber block 12 has, at a longitudinally intermediate part, two concavities in the form of a left side groove 32 and a right side groove 34 which are formed in the left side surface 20 and the right side surface 22, respectively. Each of the two grooves 32, 34 is a substantially U-shaped in cross section as shown in FIG. 2, and extends straight in the vertical direction perpendicular to the longitudinal direction of the rubber block 12, between upper and lower faces 36, 38 of the rubber block 12 and are open, at its opposite ends, in the respective upper and lower surfaces 36, 38. The left side groove 32 is offset relative to the right side groove 34 towards the fixed end of the rubber block 12, while the right side groove 34 is offset relative to the left side groove 32 towards the free end of the rubber block, so that the two grooves 32, 34 are located to be spaced apart from each other in the longitudinal direction of the rubber block 12. Thus, the two grooves 32, 34 are formed so as not to be both located in a single plane perpendicular to the length of the rubber block 12. In other words, the two grooves 32, 34 are located at different positions as viewed in the longitudinal direction of the rubber block 12.

Each of the right and left side grooves 34, 32 is formed such that its bottom does not reach a laterally central line CL which vertically extends and passes through the central axis of the rubber block 12, as seen in FIG. 3. In the present embodiment, the left side groove 32 has a constant depth, so that the distance of its bottom to the laterally central line CL is constant, as indicated in FIG. 3 . The right side groove 34, on the other hand, has a small-depth portion, a large-depth portion and a varying-depth portion between the small-depth and large-depth portions. The small-depth portion located above the varying-depth portion (as viewed in FIG. 3) has a depth substantially half as large as that of the left side groove 32. The intermediate varying-depth portion is sloped such that the depth progressively increases in the vertical direction from small-depth portion toward the large-depth portion.

As described above, the rubber block 12 constructed according to the present embodiment is generally symmetric with respect to the laterally central line CL. More precisely, one of the opposite side portions of the laterally central line CL which is located on the left side has a smaller volume over the entire length of the rubber block 12 than the other side portion which is located on the right side, since the left side surface 20 has at its lower end portion the cutout portion 24 formed to extend over the entire length while the right side groove 34 has at the upper small-depth portion.

Accordingly, the left side portion has a smaller spring constant with respect to a load applied thereto in the longitudinal direction, than the right side portion. The left side portion is compressed or deformed to a larger extent than the right side portion, upon application of a compressive load to the rubber block 12 in the longitudinal direction, whereby the rubber block 12 is likely to be generally bent such that the distal or free end portion is displaced leftward relative to the proximal or fixed end portion (the free end portion is displaced downward as viewed in FIG. 2). Each of the right and left side grooves 34, 32 has a width which is substantially constant as viewed in its depth direction (as shown in FIG. 2) as well as in its longitudinal direction (as shown in FIG. 1), and the bottom of each of the grooves 34, 32 has a semicircular shape in cross section taken in the horizontal plane, so that local stress concentration in the rubber block 12 is minimized.

The attaching member 14 attached to the proximal end of the rubber block 12 has a main body 42 which is a substantially rectangular solid block, and a holding portion 44 in the form of a rectangular plate which is formed integrally with the main body 42 so as to be opposed to the fixing portion 28 of the rubber block 12. The holding portion 44 protrudes outwardly from the main body 42 and accommodates therein a part of the fixing portion 28. That is, the fixing portion 28 is partially embedded in the holding portion 44 and is bonded to the outer surface of the holding portion 44. The rubber block 12 and the holding portion 44 may be bonded to each other with a suitable adhesive after the rubber block 12 and the attaching member 14 have been formed independently of each other, or alternatively may be bonded to each other in a vulcanization process wherein a rubber material of the rubber block 12 is vulcanized in a mold in which the previously formed attaching member 14 is suitably positioned before injection of the rubber material. However, for facilitating the bonding operation or preventing deformation of the attaching member 14 of the resin material due to heat generated in the vulcanization process, the rubber block 12 is preferably first formed in a vulcanization process and the formed rubber block 12 is then suitably positioned in a mold in which the attaching member 14 is formed so that the rubber block 12 is bonded to the attaching member 14 in process of molding, utilizing heat generated in the molding process. In this case, a suitable adhesive may be employed as needed to bond the rubber block 12 to the attaching member 14.

The attaching member 14 further has a generally hook-shaped end engaging portion 46 formed on one of opposite faces of the main body 42 which is remote from the holding portion 44. The engaging end portion 46 projects outwardly in the right direction as viewed in FIGS. 1 and 2, from the lower end portion of the above-indicated one of the opposite faces of the main body 42, and is then curved to extend upwardly such that its free end is located above the upper end of the main body 42. The end engaging portion 46 is constituted by a plate-like body whose width (as seen in FIG. 2) is substantially equal to that of the main body 42, and has an integrally formed outer engaging tab 48 which protrudes from the vicinity of the free end of the end engaging portion 46 in a direction toward the main body 42. The main body 42 has an integrally formed inner engaging tab 50 which protrudes from a substantially central portion of the above-indicated one of the opposite faces of the main body 42 in a direction toward the end engaging portion 46.

Figure 5:
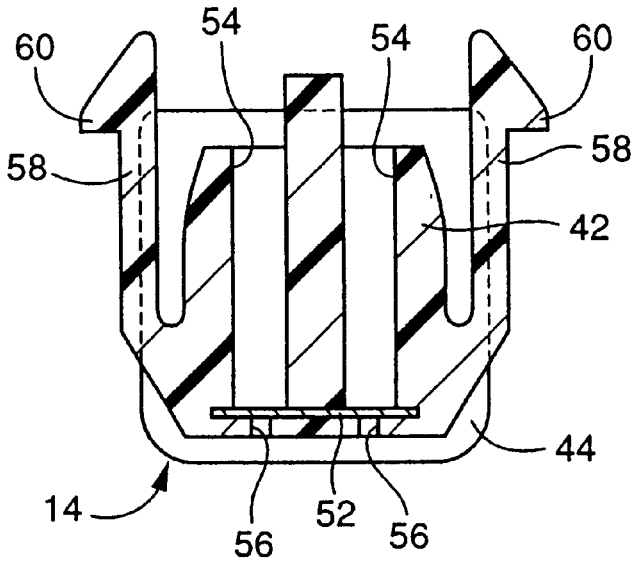
FIG. 5 is a cross sectional view taken along line 5—5 of FIG. 1.
Figure 6:
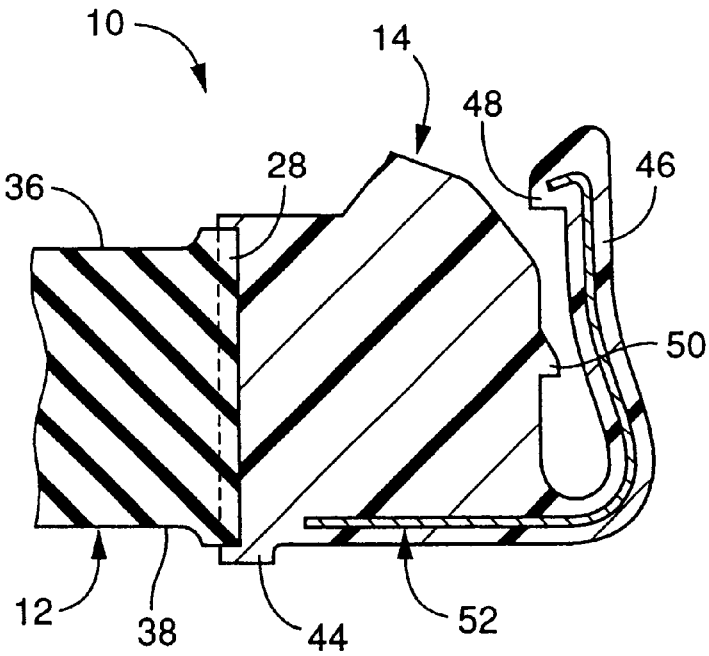
FIG. 6 is a cross sectional view taken along line 6—6 of FIG. 2.
Figure 7:
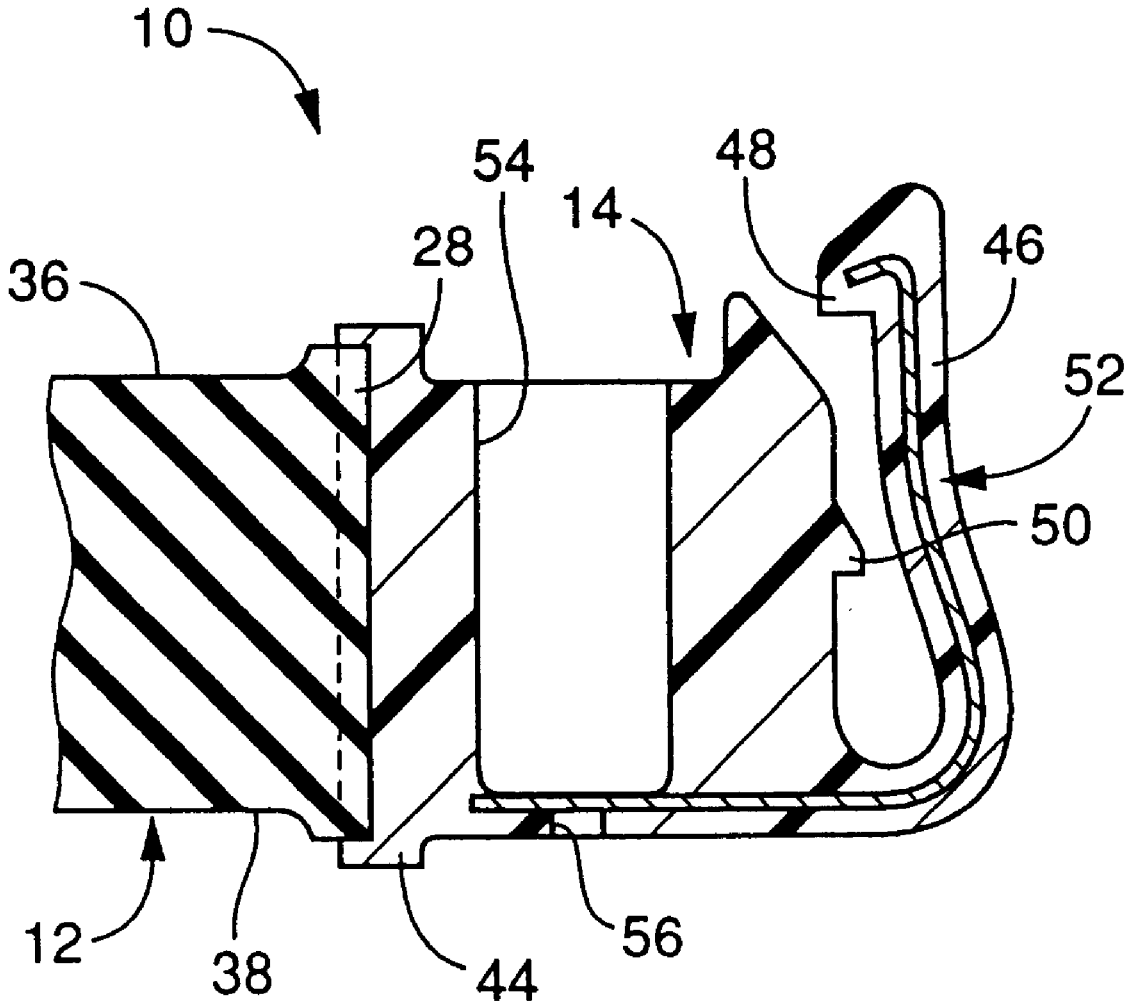
FIG. 7 is a cross sectional view taken along line 7—7 of FIG. 2.

The attaching member 14 further has a reinforcing plate 52 made of a metallic material, which is embedded in the attaching member 14 and extends from the outer engaging tab 48 through the main body 42 to the vicinity of the holding portion 44, as shown in FIGS. 1 and 2. More specifically described, the reinforcing plate 52 extends over the entirety of the end engaging portion 46 and is located at a substantially central point of the thickness of the engaging end portion 46 as viewed in the thickness direction of the engaging portion 46, and further extends from the proximal end of the engaging portion 46 through the main body 42 to the vicinity of the holding portion 44. The end engaging portion 46 is reinforced by this reinforcing plate 52, thereby obtaining a large force for restoring its original shape. The reinforcing plate 52, which is preferably made of a spring steel or other suitable material to generate an effective elastic or resilient force, is suitably positioned in a mold in which the main body 42 is formed, so that the reinforcing plate 52 is embedded in the main body 42 while the main body 42 is formed in the mold. The main body 42 thus formed has holes 54, 56, as shown in FIG. 5, which are formed in the presence of fixtures or jigs used to hold the reinforcing plate 52 in position in the mold. The provision of these holes 54, 56 in the main body 42 serves to reduce the overall weight of the attaching member 14.

Figure 4:
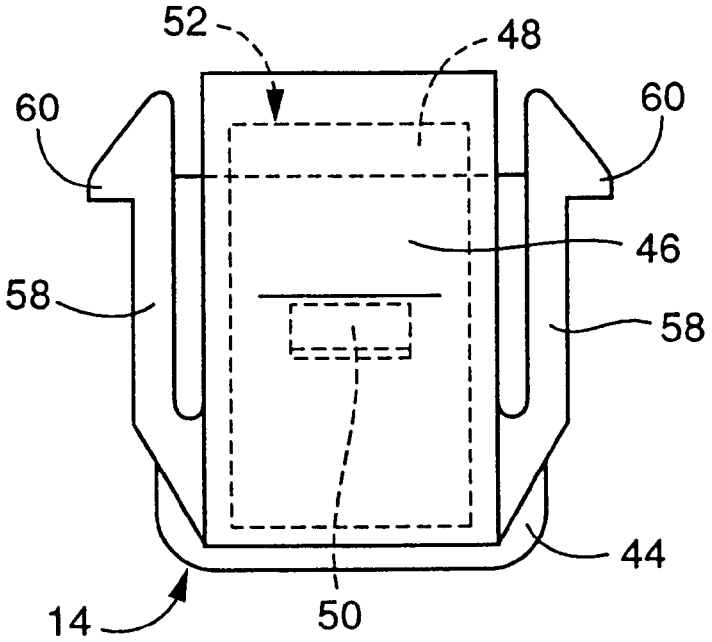
FIG. 4 is a right side elevational view of the stopper of FIG. 1.

The attaching member 14 further has a pair of lateral engaging portions 58, 58 formed on respective opposite faces of the main body 42, i.e., on the respective right and left side faces of the main body 42 as viewed in FIGS. 4 and 5. Each of the lateral engaging portions 58, 58 projects laterally outwardly from the lower end portion of the right or left side face of the main body 42, and then extends upwardly along the right or left side face such that its free end is located above the upper end of the main body 42. Each of the lateral engaging portions 58, 58 has an integrally formed engaging tab 60 which laterally outwardly protrudes from the vicinity of its free end.

Figure 10:
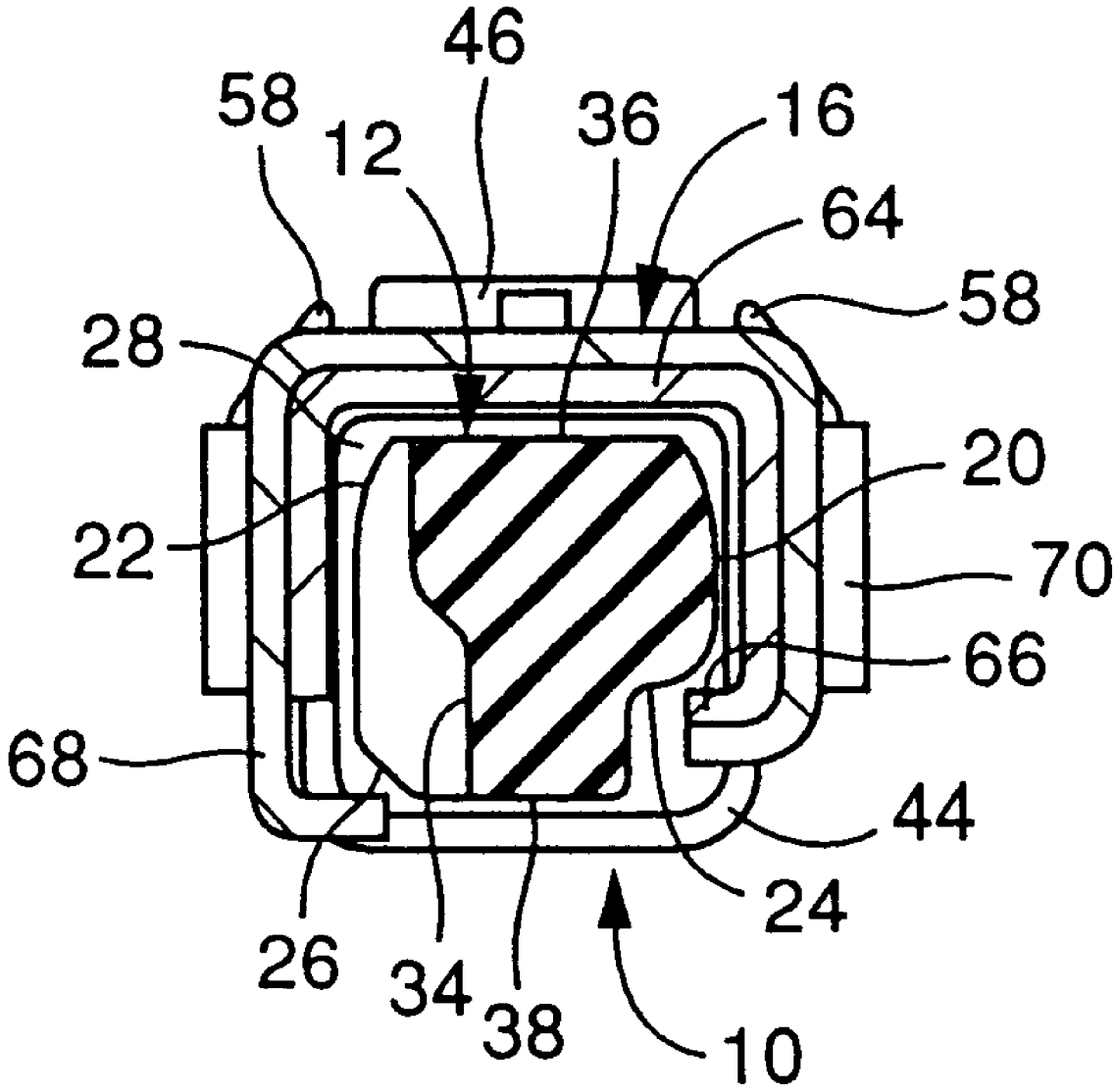
FIG. 10 is a cross sectional view taken along line 10—10 of FIG. 9.

The sliding door stopper 10 constituted by the rubber block 12 and the attaching member 14 which are constructed as described above is fixedly attached to a door-open end portion of the guide rail 16, at which the sliding door (not shown) suspended and guided by the guide rail 16 is fully opened, as shown in FIGS. 8–10. The guide rail 16 includes a main body 64 which is made of a metallic material and which has an inverted U-shaped cross sectional shape and is open downwards. The main body 64 has opposite side portions which define an opening at their lower ends. One of these opposite side portions is inwardly bent to provide an engaging portion 66, as best seen in FIG. 10. This main body 64 is mounted on the side panel of the vehicle body, for thereby serving as a guide track 62 which extends straight in parallel to the running direction of the vehicle. A roller attached to the sliding door is fitted in the guide track 62 and is engaged with the engaging portion 66, so as to be guided by the guide track 62 movably on the guide track 62 parallel to the running direction of the vehicle.

The guide rail 16 further includes a covering member 68 which is made of a metallic material. The covering member 68 has an inverted U-shaped cross sectional shape and is open downwards like the main body 64, but is larger in cross section than the main body 64. This covering member 68 is fitted on the main body 64 and extends over a predetermined distance from the door-open end portion of the guide rail 16. Laterally opposite side wall portions of the covering member 68 are bent laterally inwardly at their lower ends, so as to be calked against the main body 64, so that the covering member 68 and the main body 64 are fixed to each other. The main body 64 and the covering member 68 may be welded together, if needed. From the respective laterally opposite side wall portion of the covering member 68, two extension side walls 69, 69 are formed integrally with the covering member 68, so as to project outwardly in the longitudinal direction of the main body 64, as shown in FIGS. 9 and 10. The two extension side walls 69, 69 are connected to each other at their free ends by a substantially U-shaped end wall 70 which consists of laterally opposite side portions and a bottom portion connecting these side portions. The laterally opposite side portions are superposed on the laterally outer surfaces of the respective two extension side walls 69, 69, with a longitudinally inward movement of the end wall 70 towards the two extension side walls 69, 69. This end wall 70 is fixed to the free end portions of the two extension side walls 69, 69, and cooperates with the two extension side walls 69, 69 to constitute a stopper holding portion 72 which has a frame-like shape and encloses the longitudinal open end of the main body 64. The end wall 70 has an engaging hole 74 which is formed through a substantially central part of the bottom portion of the end wall 70, as shown in FIGS. 8 and 9.

The sliding door stopper 10 is installed in the guide rail 16 constructed as described above, such that the attaching member 14 of the sliding door stopper 10 is almost entirely located within the stopper holding portion 72 of the guide rail 16 while the rubber block 12 of the sliding door stopper 10 is located within the guide track 62 of the guide rail 16. Described more specifically, the attaching member 14 is brought into engagement with the stopper holding portion 72 with an upward movement of the attaching member 14 towards the stopper holding portion 72, such that the end wall 70 is gripped by the main body 42 and the end engaging portion 46 which is positioned outside the stopper holding portion 72, as best seen in FIG. 9, and such that the pair of lateral engaging portions 58, 58 are superposed on the laterally inner surfaces of the respective extension side walls 69 of the stopper holding portion 72, as best seen in FIG. 8. Further, the outer engaging tab 48 of the engaging end portion 46 and the engaging tabs 60, 60 of the respective lateral engaging portions 58 engage the upper end face of the stopper holding portion 72, while the inner engaging tab 50 of the main body 42 engages the engaging hole 74 of the stopper holding portion 72. The attaching member 14 is thus fixedly attached to the stopper holding portion 72, whereby the rubber block 16 is suitably positioned relative to the guide rail 16, so as to project over a predetermined distance from the longitudinal end of the guide rail 16 while being almost entirely accommodated in the guide track 62 at the longitudinal end portion of the guide rail 16, such that the right side surface 22 of the rubber block 12 is located nearer to the interior of the vehicle body while the left side surface 20 of the rubber block 12 is located remote from the interior of the vehicle body (located nearer to the exterior of the vehicle body).

The rubber block 12 which is attached to the guide rail 16 as described above is adapted for abutting contact at its free end face (30) with the roller attached to the sliding door, so as to limit the sliding movement of the sliding door at the fully open position in a damping or cushioning manner, when the sliding door is moved to be opened. Owing to the provision of the right and left side grooves 34, 32 in the respective right and left side faces 20, 22 of the rubber block 12, the rubber block 12 exhibits a smaller spring constant with respect to a load applied thereto in the longitudinal direction in an initial period of the abutting contact with the roller, than the conventional solid rubber block. After the initial period, the spring constant of the rubber block 12 is in-linearly increased as the elastic deformation of the rubber block 12 further progresses. In other words, the rubber block 12 which exhibits comparatively high flexibility in the initial period becomes stiffer after the initial period. The thus varying spring constant permits the rubber block 12 to satisfactorily damp the impact while assuredly limiting the sliding movement of the sliding door at the fully open position. Further, the right and left side grooves 34, 32 are located so as to be spaced apart from each other along the periphery of the rubber block 12 as viewed in the transverse cross section (more precisely, located on the laterally opposite surfaces 20, 22 on the opposite sides of the central axis of the rubber block 12), and also so as to be spaced apart from each other in the longitudinal direction, by a distance large enough to prevent excessive local stress concentration due to the variation in the cross sectional area. The non-linearly varying spring constant is thus established in the rubber block 12 without considerably deteriorating the durability and increasing the size of the rubber block 12.

Therefore, the sliding door stopper 10 having the above-described features is effective to prevent a rebounding motion and a shaking or rattling motion of the sliding door upon arrival of the sliding door at the fully open position, resulting in outstandingly improved opening and closing smoothness and stability of the sliding door.

In the sliding door stopper 10 of the present embodiment in which the rubber block 12 is constructed such that the longitudinal spring constant on the left side of the laterally central line CL is smaller than that on the right side, the rubber block 12 is likely to be generally bent such that the free end portion is displaced leftward relative to the fixed end portion, whereby the roller brought into abutting contact with the free end face 30 is likely to be displaced together with the free end portion of the rubber block 12 in a direction away from the vehicle body towards the exterior of the vehicle body. In addition, the free end face 30 is curved or inclined towards the exterior of the vehicle body and the fixed end face of the rubber block 12, so that the roller brought into abutting contact with the curved end face 30 is guided to be displaced away from the vehicle body towards the exterior of the vehicle body. Thus, the roller is accordingly is prevented from being displaced towards the interior of the vehicle body. The sliding door which has been moved to the fully open position is thus held separated from the vehicle body, thereby preventing problematic scratches or other damages of the vehicle body due to interference of the sliding door with the vehicle body.

In the sliding door stopper 10 of the present embodiment, the attaching member 14 made of the synthetic resin is fixed to the rubber block 12, and the attaching member 14 has the three engaging portions 46, 58, 58. The sliding door stopper 10 can be easily and quickly mounted on the guide rail 16 owing to the presence of the engaging portions 46, 58, 58 which are brought into engagement with the respective portions of the guide rail 16. More specifically, the three engaging portions 46, 58, 58 of the attaching member 14 engages the end portion and the right and left side portions of the stopper holding portion 72 in the form of a U-shaped frame, whereby the attaching member 14 is firmly attached to the guide rail 16 through the simple engaging portions. Further, the engaging end portion 46 functions to suitably position the sliding door stopper 10 relative to the guide rail 16 in the longitudinal direction while receiving a load from the sliding door upon abutting contact with the sliding door stopper 10. Since the engaging end portion 46 is reinforced by the reinforcing plate 52, the rubber block 12 is further firmly fixed to the rail stopper 10 and has excellent durability.

While the embodiment of the present invention has been described above for illustrative purpose only, it is to be understood that the present invention is not limited to the details of the above-described embodiment but may be embodied with various changes, modifications and improvements.

For example, the shapes, number and positions of the concavities formed in the rubber block 12, and the positional relationship of the concavities may be suitably determined depending upon the desired spring characteristic or other factor of the rubber block 12. That is, while the two grooves 34, 32 are formed in the rubber block 12 in the above-illustrated embodiment, it is possible to form three or more grooves in the rubber block 12 as far as the grooves are formed at respective different positions which are spaced from each other along the periphery of the rubber block 12 as viewed in the transverse cross section. Further, while the two grooves 34, 32 are formed in the respective right and left side surfaces 22, 20 in the illustrated embodiment, the grooves may be formed in any two or more of the four surfaces 20, 22, 36, 38.

While the cross sectional shape of the rubber block 12 in the illustrated embodiment is substantially rectangular, the rubber block 12 may have any other polygonal or circular cross sectional shape. That is, the cross sectional shape may be suitably selected depending upon the desired spring characteristic with respect to a load applied in the longitudinal direction, or the shape of the space in which the rubber block 12 is accommodated, or other factor.

The construction of the guide rail on which the sliding door stopper is installed is not limited to the detail of the above-described embodiment but may be modified as desired. For example, the sliding door stopper of the present invention can be applied to a guide rail having a guide track which is open upwardly.

The present invention can be applied to a sliding door assembly including a holding mechanism which is provided in the guide rail for holding the opened sliding door in the fully open position, or a sliding door assembly including a locking mechanism for locking the lower portion of the sliding door to a desired member associated with the vehicle body, or any other kind of sliding door assembly. Further, it is to be understood that the present invention can be applied to any kind of sliding door assembly which is installed at a door opening in a rear panel as well as a side panel of a vehicle body.

It is to be understood that the present invention may be embodied with various other changes, modifications and improvements, which may occur to those skilled in the art, without departing from the spirit and scope of the present invention defined in the following claims:

What is claimed is:

1. A sliding door stopper attached to a guide rail for limiting a sliding movement of a vehicle sliding door relative to a vehicle body in a direction of opening of the sliding door to a fully open position thereof, by abutting contact of the sliding door with the sliding door stopper in a cushioning manner, wherein the sliding door stopper is attached to a longitudinal end of the guide rail adopted to be mounted on the vehicle body, and the sliding door is suspended from and guided by the guide rail so as to be slidable along the guide rail, said sliding door stopper comprising:

an elastic body extending in a longitudinal direction of said guide rail away from said longitudinal end of said guide rail and having opposite longitudinal end faces one of which is adapted for abutting contact with said sliding door, said elastic body having a plurality of concavities each of which is formed in an outer surface of said elastic body so as to extend in a direction intersecting a longitudinal direction of said elastic body which is parallel to said longitudinal direction of said guide rail.

2. A sliding door stopper according to claim 1, wherein each of said concavities has a predetermined depth which is smaller than a distance from said outer surface to a central axis of said elastic body which is parallel to said longitudinal direction thereof.

3. A sliding door stopper according to claim 2, wherein said concavities are spaced apart from each other as viewed in said longitudinal direction of said elastic body.

4. A sliding door stopper according to claim 2, wherein said concavities extend from said outer surface in respective directions at least two of which are different from each other.

5. A sliding door stopper according to claim 1, wherein a laterally outer side portion of said elastic body has a smaller volume than a laterally inner side portion of said elastic body, said laterally outer side portion being located on one of laterally opposite sides of a central axis of said elastic body, said laterally inner side portion being located on the other of said laterally opposite sides of said central axis of said elastic body, said central axis being parallel to said longitudinal direction of said elastic body.

6. A sliding door stopper according to claim 5, wherein said elastic body has a cutout which is formed in said laterally outer side portion of said elastic body and which extends in said longitudinal direction of said elastic body.

7. A sliding door stopper according to claim 1, wherein each of said concavities has a predetermined depth such that a laterally outer side portion of said elastic body has a smaller spring constant with respect to a load applied thereto in said longitudinal direction, than a laterally inner side portion of said elastic body, said laterally outer side portion being located in one of laterally opposite sides of a central axis of said elastic body, said laterally inner side portion being located on the other of said laterally opposite sides of said central axis of said elastic body, said central axis being parallel to said longitudinal direction of said elastic body.

8. A sliding door stopper according to claim 1, wherein said one of opposite longitudinal end faces of said elastic body is inclined with respect to a direction perpendicular to said longitudinal direction of said elastic body, such that a length of said elastic body increases as viewed in a direction away from a laterally outer side portion of said elastic body toward a laterally inner side portion of said elastic body, said laterally outer side portion being located on one of laterally opposite sides of a central axis of said elastic body, said laterally inner side portion being located on the other of said laterally opposite sides of said central axis of said elastic body, said central axis being parallel to said longitudinal direction of said elastic body.

9. A sliding door stopper according to claim 1, further comprising an attaching member which is made of a synthetic resin, said attaching member being fixed to the other of said opposite longitudinal end faces of said elastic body, said sliding door stopper being fixedly attached through said attaching member to said longitudinal end of said guide rail.

10. A sliding door stopper according to claim 9, wherein said attaching member has a reinforcing plate which is embedded in a portion of said attaching member, said portion of said attaching member constituting an engaging portion which engages said longitudinal end of said guide rail.

11. A sliding door stopper according to claim 10, wherein said reinforcing plate is made of a metallic material.

12. A sliding door stopper according to claim 9, wherein said attaching member includes a pair of lateral engaging portions and an end engaging portion formed integrally with said attaching member, said lateral engaging portions projecting from respective laterally opposite surfaces of said attaching member, said end engaging portion projecting from one of opposite end faces of said attaching member which is remote from said elastic body.

* * * * *